United States Patent [19]

Butler

[11] Patent Number: 4,715,073

[45] Date of Patent: Dec. 29, 1987

[54] TILTABLE BED FRAME ASSEMBLY

[76] Inventor: Wilbur T. Butler, 4039 Spyglass Rd., Oklahoma City, Okla. 73120

[21] Appl. No.: 899,488

[22] Filed: Aug. 22, 1986

[51] Int. Cl.[4] ..... A61G 7/00; A47C 21/00

[52] U.S. Cl. ..... 5/62; 5/509

[58] Field of Search ..... 5/11, 60–66, 5/79, 108, 109, 184, 433, 509

[56] References Cited

U.S. PATENT DOCUMENTS

| | | | |
|---|---|---|---|
| 77,001 | 4/1868 | Collender | 5/63 |
| 503,196 | 8/1893 | Cooke . | |
| 506,056 | 10/1893 | Millar . | |
| 948,120 | 2/1910 | Wilson et al. . | |
| 1,008,168 | 11/1911 | Markus | 5/184 |
| 1,043,517 | 11/1912 | Gavan . | |
| 1,191,772 | 7/1916 | Dickerson . | |
| 2,326,183 | 8/1943 | Urbank | 5/62 |
| 2,649,595 | 8/1953 | Lewin . | |
| 3,201,806 | 8/1965 | Hutt | 5/62 |
| 3,789,437 | 2/1974 | Garte | 5/62 |
| 4,028,753 | 6/1977 | Rios | 5/108 |
| 4,277,857 | 7/1981 | Svehaug | 5/62 |

FOREIGN PATENT DOCUMENTS

| | | |
|---|---|---|
| 1491274 | 10/1969 | Fed. Rep. of Germany . |
| 541889 | 4/1956 | Italy . |
| 207715 | 12/1923 | United Kingdom . |
| 2039731 | 8/1980 | United Kingdom . |

*Primary Examiner*—Gary L. Smith
*Assistant Examiner*—Michael F. Trettel
*Attorney, Agent, or Firm*—Bill D. McCarthy

[57] ABSTRACT

A tiltable bed frame assembly is provided which permits one to adjust the angular disposition of a mattress between a horizontally disposed position and an inclined position, while at the same time permitting one to utilize a conventional mattress and the headboard and footboard components of the user's bedroom suit. The improved tiltable bed frame assembly of the present invention comprises a main frame, a mattress frame supported by the main frame, an inclined ramp assembly supported on the main frame so as to be disposed below the mattress frame and selectively moveable along the main frame, and a ramp engaging assembly connected to the mattress frame and supported on the inclined ramp assembly for elevationally moving a selected portion of the mattress frame relative to the main frame as the inclined ramp assembly is moved along the main frame. An actuation assembly, such as a linear actuator is supported by the main frame and connected to the inclined ramp assembly such that upon actuation of the linear actuator the inclined ramp assembly is slideably moved in a to and fro direction a selected distance along the main frame and thereby alter the angular disposition of the mattress.

16 Claims, 6 Drawing Figures

TILTABLE BED FRAME ASSEMBLY

BACKGROUND OF THE INVENTION

1. Field of the Invention

The present invention relates to a bed frame assembly, and more particularly, but not by way of limitation, to an improved tiltable bed frame assembly wherein the position of the mattress can be selectively varied between an inclined position and a horizontal position.

2. Brief Description of the Prior Art

In order to facilitate patient treatment it is often recommended that the bedstead, and thus the mattress, be placed in an inclined position. To achieve the desired inclination of the bedstead in the home environment, objects such as books and bricks are often placed under the headboard or footboard attached to the bedstead. While allowing one to achieve the desired inclination of the mattress in such instances, this arrangement is undesireable in that the bedstead is unstable, the bed assembly is unsightly, and it is difficult to reposition the mattress and the bedstead to the normal horizontal position when desired.

In an effort to overcome the above-mentioned makeshift provisions of providing the desired degree of inclination to the patient's mattress, numerous bed assemblies and mattress constructions have been proposed by the prior art. However, such prior art devices are relatively large in size, unsightly in appearance, and are of high initial cost. Further, the prior art bed assemblies require one to alter the decor of the room; that is, the user is required to replace the normal bed assembly with the device of the prior art. Therefore, a need has long existed for an improved bed frame assembly which can provide a standard mattress with the desired inclination, while permitting a conventional headboard and footboard to be used with the frame assembly so that the decor of the bed corresponds to the remaining decor of the room in which such bed is used. It is to such a bed frame assembly that the subject invention is directed.

SUMMARY OF THE INVENTION

According to the present invention, an improved bed frame assembly is provided which permits one to adjust the angular disposition of a mattress between a horizontally disposed position and an inclined position, while at the same time permitting one to utilize a conventional mattress and the headboard and footboard components of the user's bedroom suit. Broadly, the improved bed frame assembly of the present invention comprises a main frame, a mattress frame supported by the main frame, an inclined ramp assembly supported on the main frame so as to be disposed below the mattress frame and selectively moveable along the main frame, and a ramp engaging assembly connected to the mattress frame and supported on the inclined ramp assembly for elevationally moving a selected portion of the mattress frame relative to the main frame as the inclined ramp assembly is moved along the main frame. In order to achieve the desired movement of the inclined ramp assembly along the main frame, an actuation assembly, such as a linear actuator, is supported by the main frame and connected to the inclined ramp assembly such that upon actuation of the linear actuator the inclined ramp assembly is selectively moved in a to and fro direction a selected distance along the main frame of the bed assembly.

An object of the present invention is to provide an improved bed frame assembly for use with a conventional mattress, wherein the angular disposition of the mattress may be selectively moved between a horizontal position and an inclined position.

Another object of the present invention, while achieving the before-stated object, is to provide an improved tiltable bed frame assembly which can be attached to a conventional headboard and footboard so that the bed frame assembly does not detract from the decor of the room.

Another object of the present invention, while achieving the before-stated objects, is to provide an improved tiltable bed frame assembly which, when in a substantially horizontally disposed position, provides an appearance of a conventional bed, but which can be readily moved between the horizontal position and a desired inclined position.

Yet another object of the present invention, while achieving the above-stated objects, is to provide an improved tiltable bed frame assembly which is durable in construction, economical to manufacture, and which does not suffer from the aesthetic and functional disadvantages of the prior art devices.

Other objects, advantages and features of the present invention will become apparent to those skilled in the art from a reading of the following description when read in conjunction with the drawings and the appended claims.

DESCRIPTION OF PREFERRED EMBODIMENTS

Figure 1:
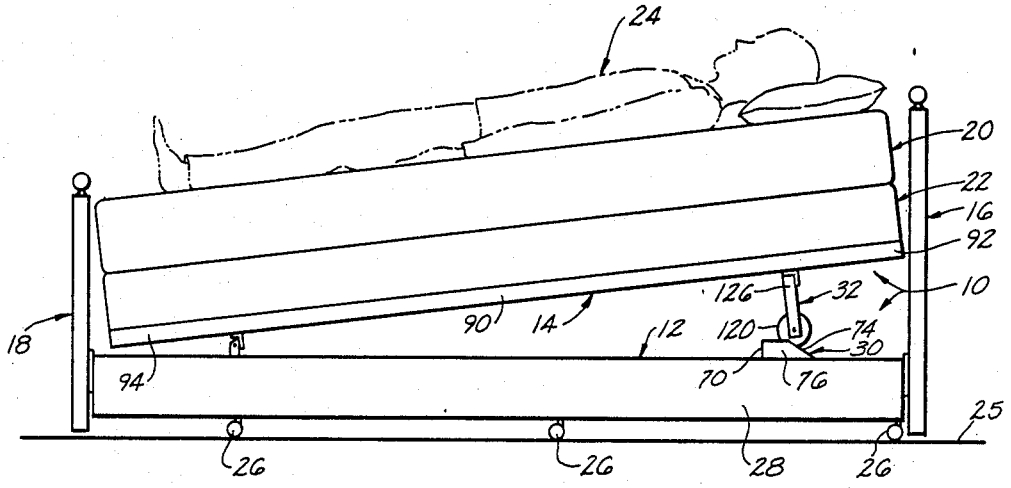
FIG. 1 is a side elevational view of an improved tiltable bed frame assembly constructed in accordance with the present invention, and illustrating a patient supported on a conventional mattress and spring set in an inclined position.

Referring now to the drawings, and more particularly to FIG. 1, shown therein is a tiltable bed frame assembly 10 constructed in accordance with the present invention. The tiltable bed frame assembly 10 comprises a main frame 12 (see FIGS. 2–4) and a mattress frame 14 supported by the main frame 12. The main frame 12 is connectable to a conventional headboard 16 at one end thereof, and to a conventional footboard 18 at the opposed end thereof.

The mattress frame 14 supportingly receives a conventional mattress 20 and spring 22 so that a patient 24 can be supported thereon. The construction of the main frame 12 and the mattress frame 14 permits one to use a conventional mattress; and the size of the main frame 12 and the mattress frame 14 can be fabricated for varying sizes of mattresses.

The connection of the main frame 12 to the headboard 16 and the footboard 18 can be achieved by any manner well known in the art as will be discussed hereinafter. It is not believed necessary that a detailed description of the connection of the main frame 12 to the headboard 16 and the footboard 18 be set forth in order to enable one to fully understand the construction and operation of the tiltable bed frame assembly 10 of the present invention. However, it should be noted that because of the unique design and construction of the tiltable bed frame assembly 10, the headboard 16 and the footboard 18 illustrated in combination with the tiltable bed frame assembly 10 can be components of the user's bedroom suit so that the decor of the bedroom in which the tiltable bed frame assembly 10 is employed is consistent and appears to be of conventional bed construction when the tiltable bed frame assembly 10 is in the horizontally disposed position.

In order to permit movement of the tiltable bed frame assembly 10 over a supporting surface, such as a floor 25, a plurality of casters 26 are connected to the main frame 12. In addition, in order to enhance the aesthetic qualities of the tiltable bed frame assembly 10, decorative panels, such as decorative panel 28, can be secured to the main frame 12 to conceal the components forming the main frame 12.

Figure 2:
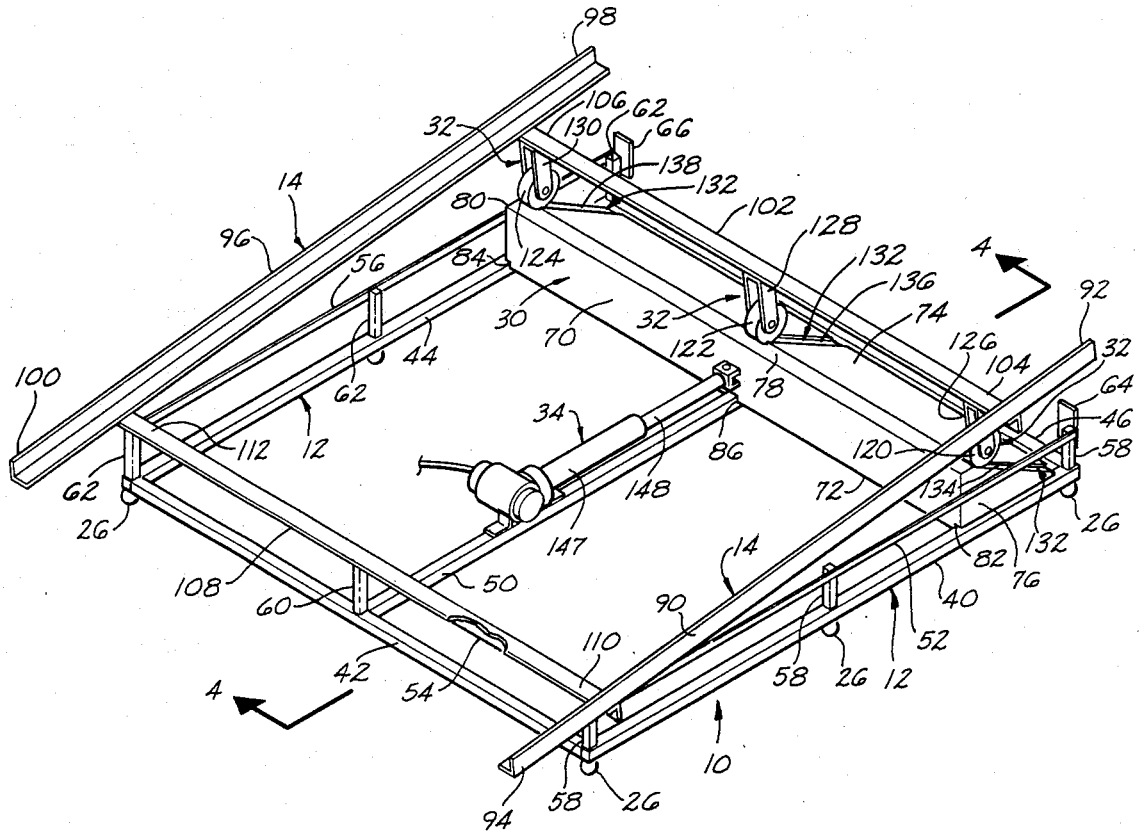
FIG. 2 is a partial cutaway, perspective view of the improved tiltable bed frame assembly of the present invention wherein a mattress frame is disposed in an inclined position relative to a main frame.
Figure 3:
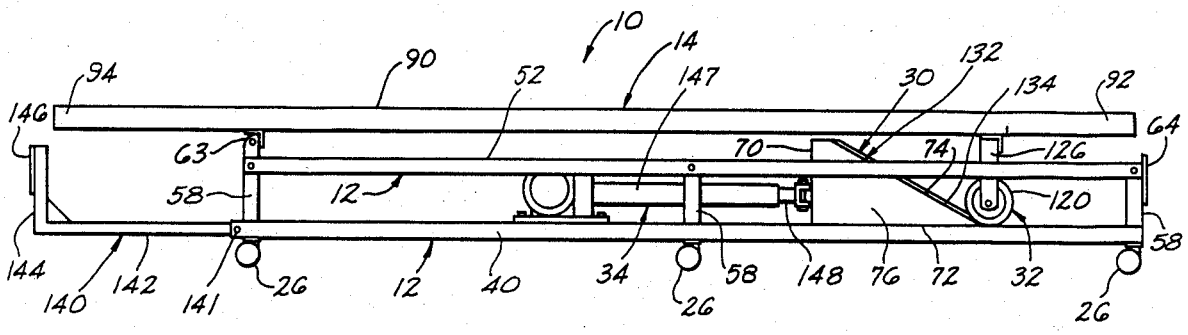
FIG. 3 is a side elevational view of the improved tiltable bed frame assembly of FIG. 1 wherein the mattress frame is disposed in a substantially horizontal position, and illustrating a footboard support assembly for selectively extending the length of the main frame.
Figure 4:
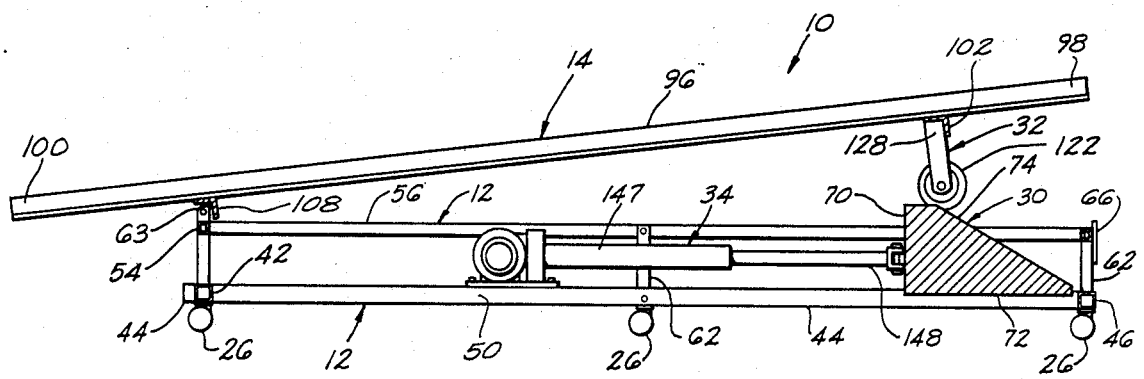
FIG. 4 is a cross-sectional view of the improved tiltable bed frame assembly of FIG. 2 taken along the lines 4—4 thereof.

Referring now to FIGS. 1–4, the tiltable bed frame assembly 10 further comprises an inclined ramp 30 supported by one end portion of the main frame 12, a ramp engaging assembly 32 connected to the mattress frame 14 and supported on the inclined ramp 30 for elevationally moving a portion of the mattress frame 14 relative to the main frame 12 as the inclined ramp 30 is moved along the main frame 12, and a ram 34 supported by the main frame 12 and connected to the inclined ramp 30 such that upon actuation of the ram 34 the inclined ramp 30 is selectively moved a predetermined distance along the main frame 12 in a to and fro direction. As will be more fully described hereinafter, the configuration of the inclined ramp 30, and the movement of the inclined ramp 30, in combination with the ramp engaging assembly 32 permits the angular disposition of the mattress frame 14 to be varied relative to the main frame 12 as the inclined ramp 30 is moved in the to and fro direction along the main frame 12 in response to actuation of the ram 34. Thus, the angular disposition of the mattress frame 14 can be readily altered between an inclined position (as illustrated in FIGS. 1, 2 and 4), or a substantially horizontally disposed position (as illustrated in FIG. 3).

Referring more specifically to FIGS. 2–4, the main frame 12 is illustrated as a substantially rectangularly shaped member having opposed, spatially disposed sides and opposed, spatially disposed ends. Any suitable means can be employed for fabricating the main frame 12. For example, the main frame 12 can be fabricated of a plurality of elongated members, such as elongated members 40, 42, 44 and 46, which are rigidly interconnected at their adjoining ends so as to provide the main frame 12 with a substantially rectangularly shaped configuration. A substantially centrally disposed support member 50 extends between and is connected to the elongated members 42, 46 forming the main frame ends for supporting the inclined ramp 30 and the ram 34.

In order to support the mattress frame 14, while at the same time permitting the pivotal movement of the mattress frame 14 between the inclined position (as shown in FIGS. 1, 2 and 4) and the substantially horizontally disposed position (as shown in FIG. 3), the main frame 12 further comprises a plurality of elongated members 52, 54 and 56. The elongated member 52 is connected to and supported by the elongated member 40 of the main frame 12 via upright leg members 58 such that the elongated member 52 is disposed in a substantially parallel, spatial relationship with the elongated member 40 substantially as shown. The elongated member 54 is connected to and supported by the elongated member 42 via an upright leg member 60, the adjacent upright member 58 and an upright member 62 such that the elongated member 52 and 54 have a common horizontal plane. Further, the elongated member 54, which supports one end of the mattress frame 14, functions as a pivot support for the mattress frame 14 as the mattress frame 14 is moved between the horizontal positon and the inclined position. Because the elongated member 54 functions as the pivot support, it is desirable that the upper surface 63 of the elongated member 54 be provided with an arcuate configuration (as shown in FIGS. 3 and 4) so that the pivotal movements of the mattress frame 14 relative thereto can be achieved without any binding effect. The elongated member 56 is connected to and supported by the elongated member 44 via a plurality of upright leg members 62 such that the elongated member 56 is disposed in a substantially parallel, spatial relationship with the elongated member 44 and in a common horizontal plane with the elongated members 52 and 54.

While the main frame 12 has been illustrated as fabricated of the plurality of elongated members as described above, it should be understood that the main frame 12 functions primarily as a support for the mattress frame 14 and the inclined ramp 30. Thus, the structural configuration of the main frame 12 can be varied without departing from the spirit of the present invention, provided that the main frame 12 functions in the described manner. However, in such instances, care must be exercized to provide the main frame 12 with sufficient height so that the mattress frame 14 does not engage the supporting surface, such as the floor 20, when the mattress frame 14 is moved to the inclined position.

In order to attach the headboard 16 to the main frame 12, the upright leg members 58 and 62 secured to the end of the main frame 12 supporting the inclined ramp 30 are provided with connector plates 64, 66, respectively. The connector plates 64 and 66 are of conventional construction, and each of the connector plates 64, 66 is provided with a connector assembly connectable to a mating connector assembly provided on the headboard 16. Since connector assemblies for connecting a headboard to a bed stead are well known in the art, no further comment is deemed necessary.

From the above, it is apparent that the main frame 12 not only supports the mattress frame 14 (whether the mattress frame 14 is in a substantially horizontal position or an inclined position) but also supports the inclined ramp 30 as the inclined ramp 30 is moved in a to and fro direction along the main frame 12 to alter the angular disposition of the mattress frame 14 relative to the main frame 12.

The inclined ramp 30 comprises an elongated body member 70 having a substantially triangular-shaped cross section. The elongated body member 70 is further characterized as having a substantially planar lower surface 72, an angularly disposed upper surface 74, a first end 76, a medial portion 78 and an opposed second end 80. A recessed portion 82 is formed on the first end 76 of the elongated body member 70 via the lower planar surface 72; a recessed portion 84 is formed on the opposed second end 80 of the elongated body member 70 via the lower planar surface 72 thereof; and a recessed slot 86 is formed in the medial portion 78 of the elongated body member 70 via the lower planar surface 72 substantially as shown in FIG. 2. Thus, the recessed portions 82, 84 of the first and opposed second end 76, 80, respectively, are supportively received by the elongated members 40, 44 of the main frame 12; and the recessed slot 86 is supportively received by the support member 50 of the main frame 12 such that the elongated body member 70 is supported on the main frame 12 and slideably moveable in a to and fro direction via actuation of the ram 34.

The mattress frame 14 comprises a elongated side member 90 having a first end 92 and an opposed second end 94; and a substantially parallel, spatially disposed elongated side member 96 having a first end 98 and an opposed second end 100. The mattress frame 14 further comprises an elongated end member 102 having a first end 104 and a second end 106; and a elongated end member 108 having a first end 110 and a second end 112. The elongated end member 102 is disposed between the elongated side members 90, 96 in close proximity to the first ends 92, 98 thereof such that the first end 104 of the elongated end member 102 is connected to the elongated side member 90 and the second end 106 of the elongated end member 102 is connected to the elongated side member 96. Similarly, the elongated end member 108 is disposed between and connected to the elongated side members 90, 96 in close proximity to the second ends 94, 100 thereof such that the first end 110 of the elongated end member 108 is connected to the elongated side member 90 and the second end 112 of the elongated end member 108 is connected to the elongated side member 96. Thus, the connection of the elongated side members 90, 96 and the elongated end members 102, 108 provides the mattress frame 14 with a substantially rectangularly shaped configuration substantially as shown.

It should be noted, however, that the attachment of the elongated end members 102, 108 to the elongated side members 90, 96 will be dependent upon the positioning of the inclined ramp 30 on the main frame 12. That is, the ramp engaging assembly 32, which is supported by the elongated end member 102, must be adapted to selectively engage and move along the angularly disposed upper surface 74 of the elongated body member 70 of the inclined ramp 30 as the inclined ramp 30 is moved in a to and fro direction in response to the actuation of the ram 34 so that the inclination of the mattress frame 14 can be varied relative to the main frame 12. Further, the elongated end member 108 can be pivotally connected to and supported by the elongated member 54 of the main frame 12 for the pivotal movement of the mattress frame 14 relative to the main frame 12 as the inclined ramp 30 is moved along the main frame 12. Any suitable means can be utilized to pivotally connect the elongated end member 108 of the mattress frame 14 to the elongated member 54 of the main frame 12 in order to provide the desired lateral stability to the mattress frame 14 as same is selectively moved between one of the inclined position and the horizontally disposed position. However, desirable results have been obtained wherein the elongated member 108 is an L-shaped member adapted to engage and be supported by the elongated member 54 substantially as shown.

As previously stated, the ramp engaging assembly 32 of the tiltable bed frame assembly 10 is connected to the mattress frame 14 such that the ramp engaging assembly 32 is supported on the angularly disposed upper surface 74 of the elongated body member 70 of the inclined ramp 30 for elevationally moving the adjacent portion of the mattress frame 14 relative to the main frame 12 as the elongated body member 70 of the inclined ramp member 30 is moved along the main frame 12. The ramp engaging assembly 32 of the tiltable bed frame assembly 10 comprises a plurality of wheels 120, 122, 124 connected to and supported by the elongated end member 102 of the mattress frame 14. In order to provide the desired clearance for rotational movement of the wheels 120, 122 and 124 so that same can travel along the angularly disposed upper surface 74 of the elongated body member 70 of the inclined ramp 30, the wheels 120, 122 and 124 are connected to the elongated end member 102 via extension members or yokes 126, 128 and 130, respectively.

In order to provide lateral stability to the mattress frame 14 as the wheels 120, 122 and 124 of the ramp engaging assembly 32 travel along the angularly disposed upper surface 74 of the elongated body member 70 of the inclined ramp 30, (as the inclined ramp 30 is moved in a to and fro direction in response to actuation of the ram 34), a track 132 is provided along the angularly disposed upper surface 74 of the elongated body member 70. The configuration of the track 132 will be dependent, to a large extent, upon the configuration of the wheels 120, 122 and 124 engaging the track 132 as the inclined ramp 30 is moved in the to and fro direction. For example, desirable results can be obtained wherein the track 132 comprises a plurality of grooves formed in the angularly disposed upper surface 74 of the elongated body member 70, such as grooves 134, 136 and 138. Each of the grooves is adapted to receive one of the wheels of the ramp engaging assembly such that the wheels are disposed in and supported by the grooves for rolling movement therealong. That is, wheel 120 is disposed within the groove 134 for rolling movement therealong, wheel 122 is disposed within the groove 136 for rolling movement therealong, and wheel 124 is disposed within the groove 138 for rolling movement therealong. By providing the grooves as described above in the angularly disposed upper surface 74 of the elongated body member 70, undesired lateral movement of the mattress frame 14 is prevented as the angular disposition of the mattress frame 14 is varied by movement of the inclined ramp 30 along the main frame 12, and thus the movement of the wheels 120, 122 and 124 along the angularly disposed upper surface 74 of the elongated body member 70 of the inclined ramp 30.

In most instances the overall length of the mattress frame 14 will be greater than the overall length of the main frame 12 to accommodate a conventional or extra length mattress. In such instances, one may still desire to attach the footboard 18 to the tiltable bed frame assembly 10 for aesthetic reasons. In order to permit the user to attach the footboard 18 to the tiltable bed frame assembly 10 of the present invention, the tiltable bed frame assembly 10 further comprises a footboard support assembly 140 connectable to and supported by the main frame 12 for effectively extending the overall length of the main frame 12. The footboard support assembly 140 is connected to the elongated members 40 and 44 of the main frame 12 such that the footboard support assembly 140 is selectively moveable between a retracted position and an extended position. In the retracted position the footboard support assembly 140 is telescopically received by the elongated members 40, 44 of the main frame 12 (such members being tubular or L-shaped members and thus having an hollow interior portion); whereas in the extended position the distal end of the footboard support assembly 140 extends a selected distance outwardly from the end of the main frame 14 to effectively extend the overall length of the main frame 12.

In order to stabilize the footboard support assembly 140 to the main frame 12, any suitable means can be employed, such as providing a plurality of apertures (not shown) in the end portions of the elongated members 40, 44 of the main frame 12 which are alignable with apertures (also not shown) in the footboard support assembly 140 so that a pin element, such as pin element 141, can be inserted therethrough to secure the footboard support assembly 140 in a desired position relative to the main frame 12.

The configuration of the footboard support assembly 140 can vary widely. However, as more clearly shown in FIG. 3, the footboard support assembly 140 will generally comprise a pair of leg members, such as leg member 142, adapted to be telescopically positioned within the end portion of the elongated members of the main frame 12, such as the elongated member 40. The distal end of the leg members of the footboard support assembly 140, such as the leg member 142, is connected to an upright member 144 having attached thereto conventional connector plates, such as connector plate 146, so that the footboard 18 of the bed can be attached thereto in the conventional manner. However, it is to be understood that the configuration of the footboard support assembly 140 can be varied without departing from the scope of the present invention, provided that the footboard support assembly 140 can be connected to and supported by the main frame 12 as heretofore described.

As previously stated, the to and fro direction of the inclined ramp 30 along the main frame 12 is in response to actuation of the ram 34. The ram 34 is a linear actuator having a cylinder 147 and a reciprocating member 148. The cylinder 147 is secured to support member 50 of the main frame 12; and the distal end of the reciprocating member 148 is connected to the inclined ramp 30 sustantially as shown.

The length of stroke of the reciprocating member 148 of the ram 34 determines the selected distance that the inclined ramp 30 travels along the main frame 12. Thus, any suitable ram can be employed to effectuate the selected movement of the inclined ramp 30 along the main frame 12 for the predetermined distance so that the desired degree of inclination of the mattress frame 14 relative to the main frame 12 can be achieved. Further, the ram 34 will generally be driven by an electric motor connected to a suitable power source for ease in use in a home environment. It should be understood that while the ram 34 has been depicted as the means for selectively moving the inclined ramp 30 along the main frame 12 in a to and fro direction to achieve the changes in the degree of inclination of the mattress frame 14 relative to the main frame 12, any suitable means well known in the art capable of selectively moving the inclined ramp 30 in the desired to and fro direction for a predetermined distance can be employed in the practice of the present invention.

Figure 5:
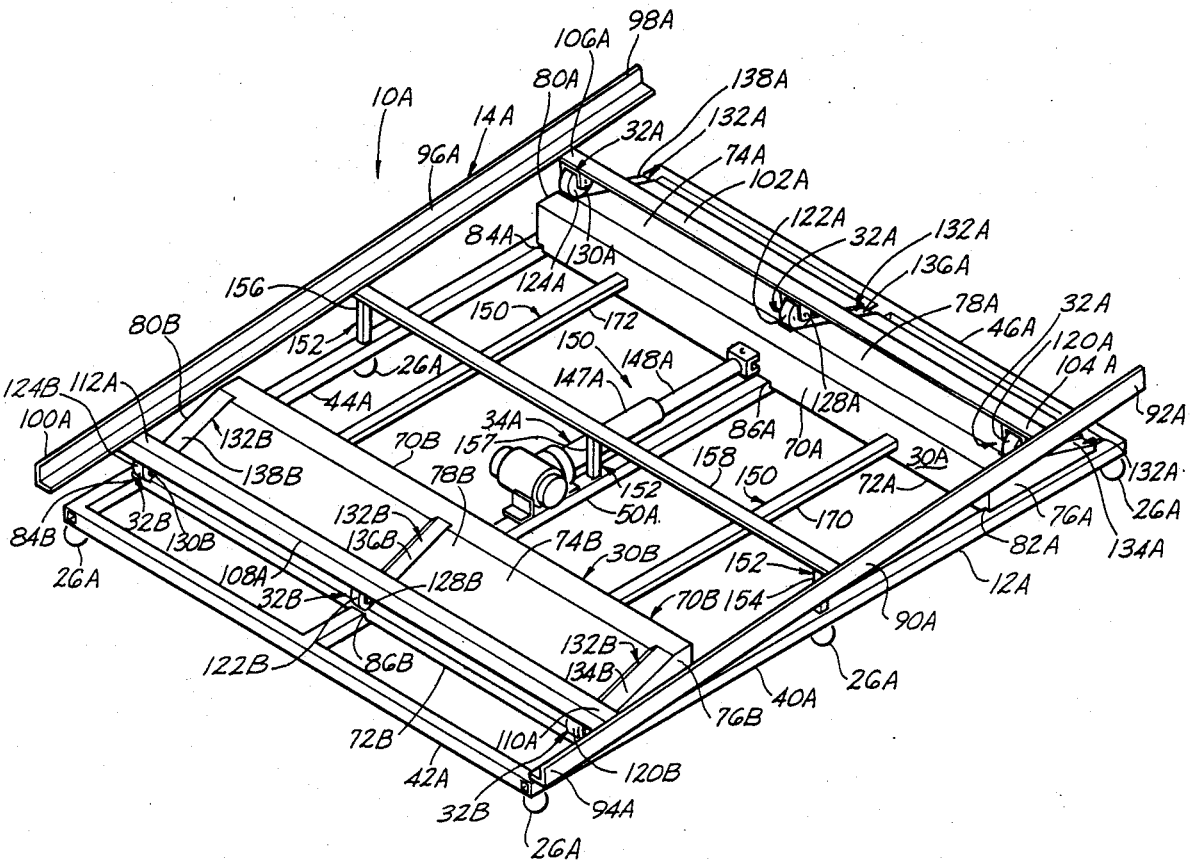
FIG. 5 is a perspective view of a second embodiment of an improved tiltable bed frame assembly of the present invention wherein an inclined ramp assembly is supported by each end portion of a main frame so as to be disposed below a mattress frame, the inclined ramp assembly selectively moveable along the main frame in a to and fro direction so that the angular disposition of the mattress frame relative to the main frame is adjusted in response to travel of the inclined ramps along the main frame.
Figure 6:
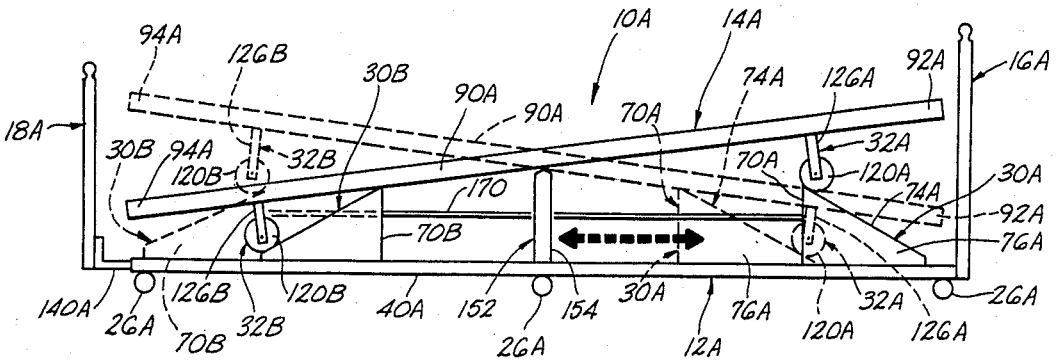
FIG. 6 is a cross-sectional view of the improved tiltable bed frame assembly of FIG. 5 illustrating the angular disposition of the mattress frame relative to the main frame as the inclined ramps are moved in the to and fro direction along the main frame.

Referring now to FIGS. 5 and 6, a second embodiment of a tiltable bed frame assembly 10A is illustrated. The tiltable bed frame assembly 10A comprises a main frame 12A and a mattress frame 14A supported by the main frame 12A. The main frame 12A can be connectable to a conventional headboard 16A at one end thereof, and to a conventional footboard 18A at the opposed end thereof. The connection of the main frame 12A to the headboard 16A and the footboard 18A can be achieved by any manner well known in the art. Thus, no further comments are deemed necessary as to the connection of the main frame 12A to the headboard 16A and the footboard 18A in order to enable one to fully understand the construction and operation of the tiltable bed frame assembly 10A of the present invention. However, it should be noted that because of the unique design and construction of the tiltable bed frame assembly 10A, the headboard 16A and the footboard 18A (illustrated in combination with the tiltable bed frame assembly 10A) can be components of the user's bedroom suit so that the decor of the bedroom in which the tiltable bed frame assembly 10A is employed is consistent and appears to be of conventional bed construction when the tiltable bed frame assembly 10A is in the horizontally disposed position. Further, in order to permit movement of the tiltable bed frame assembly 10A over a supporting surface, such as a floor, casters 26A are connected to the main frame 12A in a conventional manner.

The tiltable bed frame assembly 10A further comprises a first inclined ramp 30A supported by one end portion of the main frame 12A, a second inclined ramp 30B supported by an opposed end portion of the main frame 12A, a first ramp engaging assembly 32A connected to one end portion of the mattress frame 14A and supported on the first inclined ramp 30A, and a second ramp engaging assembly 32B connected to an opposite end portion of the mattress frame 14A and supported on the second inclined ramp 30B. A ram assembly 150 is supported by the main frame 12A and connected to the first and second inclined ramps 30A, 30B such that upon actuation of the ram assembly 150 the first and second inclined ramps 30A, 30B are selectively moved a predetermined distance along the main frame 12A in a to and fro direction. The selective movement of the first and second inclined ramps 30A, 30B, in combination with the first and second ramp engaging assemblies 32A, 32B, provides for the desired elevational movement of the mattress frame 14A relative to the main frame 12A as the first and second inclined ramps 30A, 30B are moved along the main frame 12A in response to the ram assembly 150. As will be more fully described hereinafter, the configuration of the first and second inclined ramps 30A, 30B, and the movement of the first and second inclined ramps 30A, 30B, in combination with the first and second ramp engaging assemblies 32A, 32B, permits the angular disposition of the mattress frame 14A to be varied relative to the main frame 12A as the first and second inclined ramp 30A, 30B are moved in the to and fro direction along the main frame 12A in response to actuation of the ram assembly 150. Thus, the angular disposition of the mattress frame 14A can be readily altered between an inclined position (wherein one end of the mattress frame 14A is in an elevated position relative to the opposed second end as shown by bold lines in FIG. 6), a substantially horizontally disposed position (similar in operation to the embodiment illustrated in FIG. 3), or an inclined position wherein the opposed second end of the mattress frame 14A is elevated relative to the other end (as shown by the phantom lines in FIG. 6).

The main frame 12A of the tiltable bed frame assembly 10A is illustrated as a substantially rectangularly shaped member having opposed, spatially disposed sides and opposed, spatially disposed ends. Any suitable means can be employed for fabricating the main frame 12A. For example, the main frame 12A can be fabricated of a plurality of elongated members, such as elongated members 40A, 42A, 44A and 46A, which are rigidly interconnected at their adjoining ends so as to provide the main frame 12A with a substantially rectangularly shaped configuration. A substantially centrally disposed support member 50A extends between and is connected to the elongated members 42A, 46A forming the main frame ends for supporting the first and second inclined ramps 30A, 30B, and a ram 34A of the ram actuation assembly 150.

In order to pivotally support a midportion of the mattress frame 14A at a predetermined height above the main frame 12A so that the first and second inclined ramps 30A, 30B are disposed below the mattress frame 14A, while at the same time permitting the pivotal movement of the mattress frame 14A between the inclined position and the substantially horizontally disposed position, the main frame 12A further comprises a support assembly 152. The support assembly 152 comprises an upwardly extending first leg member 154 connected to a midportion of the elongated member 40A of the main frame 12A, an upwardly extending second leg member 156 connected to a midportion of the elongated member 44A of the main frame 12A, and an upwardly extending third leg member 157 connected to a midportion of the support member 50A of the main frame 12A. A cross support member 158 of the mattress frame 14A (which will be discussed hereinafter in more detail) is pivotally supported by the upwardly extending leg members 154, 156 and 157. The height of the upwardly extending leg members 154, 156, and 157 can vary, but must be of sufficient height to permit the pivotal movement of the mattress frame 14A as the first and second inclined ramps 30A, 30B are selectively moved in a to and fro direction along the main frame 12A, while at the same time permitting the mattress frame 14A to be disposed in a substantially horizontal position. Thus, the support assembly 152 serves as a fulcrum for the mattress frame 14A as the angular disposition of the mattress frame 14A is altered in response to the selected, directional movement of the first and second ramp engaging assemblies 32A, 32B along the main frame 12A.

In order to attach the headboard 16A to the main frame 12A, the positioning of the first inclined ramp 30A on the main frame 12A must be such that when the mattress frame 14A is angularly disposed so that the adjacent end portion of the mattress frame 14A is in a downwardly extending direction (as illustrated by phantom lines in FIG. 6), the mattress frame 14A, and thus the mattress (not shown) supported thereon, do not engage the headboard 16A. Such can be accomplished by providing a sufficient length of the main frame 12A to extend outwardly from the adjacent end of the mattress frame 14A. Connector plates can be secured to the headboard connecting ends of the elongated members 40A, 44A so that the headboard 16A can be attached thereto. Such connector assemblies of a headboard to a bed stead are well known in the art, and are of conventional construction. Thus, no further comment is deemed necessary to enable one to fully understand and practice the invention herein set forth.

From the above, it is apparent that the main frame 12A not only supports the mattress frame 14A, but also supports the first and second inclined ramps 30A, 30B so that the first and second inclined ramps 30A, 30B can be moved in a to and fro direction along the main frame 12A to alter the angular disposition of the mattress frame 14A relative to the main frame 12A.

The first inclined ramp 30A comprises an elongated body member 70A having a substantially triangular-shaped cross section. The elongated body member 70A is further characterized as having a substantially planar lower surface 72A, an angularly disposed upper surface 74A, a first end 76A, a medial portion 78A and an opposed second end 80A. A recessed portion 82A is formed on the first end 76A of the elongated body member 70A via the lower planar surface 72A; a recessed portion 84A is formed on the opposed second end 80A of the elongated body member 70A via the lower planar surface 72A thereof; and a recessed slot 86A is formed in the medial portion 78A of the elongated body member 70A via the lower planar surface 72A substantially as shown in FIG. 5. Thus, the recessed portions 82A, 84A of the first and opposed second end 76A, 80A, respectively, are supportively received by the elongated members 40A, 44A of the main frame 12A, and the recessed slot 86A is supportively received by the support member 50A of the main frame 12A such that the elongated body member 70A is supported on the main frame 12A and slideably moveable in a to and fro direction via the actuation assembly 150.

The second inclined ramp 30B, which is substantially identical in construction to the first inclined ramp 30A, comprises an elongated body member 70B having a substantially triangular-shaped cross section. The elongated body member 70B is also characterized as having a substantially planar lower surface 72B, an angularly disposed upper surface 74B, a first end 76B, a medial portion 78B and an opposed second end 80B. A recessed portion (not shown, but identical to recessed portion 82A) is formed on the first end 76B of the elongated body member 70B via the lower planar surface 72B; and a recessed portion 84B is formed on the opposed second end 80B of the elongated body member 70B via the lower planar surface 72B thereof. Similarly, a recessed slot 86B is formed in the medial portion 78B of the elongated body member 70B via the lower planar surface 72B substantially as shown in FIG. 5. Thus, the recessed portions 82B, 84B of the first and opposed second end 76, 80, respectively, are supportively received by the elongated members 40A, 44A of the main frame 12A, and the recessed slot 86B is supportively received by the support member 50A of the main frame 12 such that the elongated body member 70B is supported on the main frame 12A and slideably moveable in a to and fro direction via actuation of the actuation assembly 150.

The first and second inclined ramps 30A, 30B are supported on opposite ends of the main frame 12A such that the angularly disposed upper surfaces 74A, 74B of the elongated body members 70A, 70B of the first and second inclined ramps 30A, 30B are inclined to extend toward the supporting main frame 12A in opposite directions. That is, the first and second inclined ramps 30A, 30B can be positioned on and supported by the main frame 12A such that their respective angularly disposed upper surfaces 74A, 74B extend downwardly in a direction toward the adjacent end portion of the main frame 12A (as shown in FIGS. 5 and 6), or in the alternative, the first and second inclined ramps 30A, 30B can be positioned on the main frame 12A such that their respective angularly upper surfaces 74A, 74B extend in a downwardly direction toward a midpoint of the main frame 12A.

The ram assembly 150, which will be more fully described hereinafter, provides a dual function; that is, the ram assembly 150 selectively moves the first and second inclined ramps 30A, 30B in a to and fro direction along a selected distance of the main frame 12A, and interconnects the first and second inclined ramps 30A, 30B such that movement of the first inclined ramp 30A along the main frame 12A simultaneously moves the second inclined ramp 30B along the main frame 12A in a corresponding direction to the movement to the first inclined ramp 30A. The interconnection of the first and second inclined ramps 30Aa, 30B and the controlled movement thereof by the ram assembly 150 will be described in more detail hereinafter.

The mattress frame 14A comprises a elongated side member 90A having a first end 92A and an opposed second end 94A; and a substantially parallel, spatially disposed elongated side member 96A having a first end 98A and an opposed second end 100A. The mattress frame 14A further comprises an elongated end member 102A having a first end 104A and a second end 106A; and a elongated end member 108A having a first end 110A and a second end 112A. The elongated end member 102A is disposed between the elongated side members 90A, 96A in close proximity to the first ends 92A, 98A thereof such that the first end 104A of the elongated end member 102A is connected to the elongated side member 90A and the second end 106A of the elongated end member 102A is connected to the elongated side member 96A. Similarly, the elongated end member 108A is disposed between and connected to the elongated side members 90A, 96A in close proximity to the second ends 94A, 100A thereof such that the first end 110A of the elongated end member 108A is connected to the elongated side member 90A and the second end 112A of the elongated end member 108A is connected to the elongated side member 96A. Thus, the connection of the elongated side members 90A, 96A and the elongated end members 102A, 108A provide the mattress frame 14A with a substantially rectangularly shaped configuration substantially as shown.

It should be noted, however, that the attachment of the elongated end members 102A, 108A to the elongated side members 90A, 96A will be dependent upon the positioning of the first and second inclined ramp assemblies 30A, 30B on the main frame 12A. That is, the first ramp engaging assembly 32A, which is supported by the elongated end member 102A, must be adapted to selectively engage and move along the angularly disposed upper surface 74A of the elongated body member 70A of the first inclined ramp 30A as the first inclined ramp 30A is moved in a to and fro direction along the main frame 12A so that the inclination of the mattress frame 14A can be varied relative to the main frame 12A. Similarly, the second ramp engaging assembly 32B, which is supported by the elongated end member 108A, must be adapted to selectively engage and move along the angularly disposed upper surface 74B of the elongated body member 70B of the second inclined ramp 30B as the second inclined ramp 30B is moved in a to and fro direction along the main frame 12A simultaneously with the movement of the first inclined ramp 30A so that the inclination of the mattress frame 14A can be varied relative to the main frame 12A.

As previously stated, the mattress frame 14A also comprises the cross support member 158. The cross support member 158 extends between and is connected at its opposed ends to the elongated side members 90A, 96A of the mattress frame 14A substantially as shown in FIG. 5. Thus, the cross member 158 matingly engages the upwardly extending leg members 154, 156 and 157 of the main frame 12A so that the mattress frame 14A is pivotally supported by the main frame 12A.

The first ramp engaging assembly 32A of the tiltable bed frame assembly 10A is connected to the mattress frame 14A such that the first ramp engaging assembly 32A is supported on the angularly disposed upper surface 74A of the elongated body member 70A of the first inclined ramp 30A; whereas the second ramp engaging assembly 32B is connected to the mattress frame 14A such that the second ramp engaging assembly 32B is supported on the angularly disposed upper surface 74B of the elongated body member 70B of the second inclined ramp 30B. Thus, the first and second ramp engaging assemblies 32A, 32B, in combination with the first and second inclined ramps 30A, 30B permit elevational movement of the end portions of the mattress frame 14A relative to the main frame 12A in response to the directed movement of the first and second inclined ramps 30A, 30B along the main frame 12A.

The first ramp engaging assembly 32A of the tiltable bed frame assembly 10A comprises a plurality of wheels 120A, 122A, 124A connected to and supported by the elongated end member 102A of the mattress frame 14A. In order to provide the desired clearance for rotational movement of the wheels 120A, 122A and 124A so that same can travel along the angularly disposed upper surface 74A of the elongated body member 70A of the first inclined ramp 30A, the wheels 120A, 122A and 124A are connected to the elongated end member 102A via extension members or yokes 126A, 128A and 130A, respectively.

Similarly, the second ramp engaging assembly 32B of the tiltable bed frame assembly 10A comprises a plurality of wheels 120B, 122B, 124B connected to and supported by the elongated end member 108A of the mattress frame 14A. In order to provide the desired clearance for rotational movement of the wheels 120B, 122B and 124B so that same can travel along th angularly disposed upper surface 74B of the elongated body member 70B of the second inclined ramp 30B, the wheels 120B, 122B and 124B are connected to the elongated end member 108A via extension members or yokes 126B, 128B and 130B, respectively.

In order to provide lateral stability to the mattress frame 14A as the wheels 120A, 122A and 124A of the ramp engaging assembly 32A travel along the angularly disposed upper surface 74A of the elongated body member 70A of the first inclined ramp 30A, and the wheels 120B, 122B and 124B of the second ramp engaging assembly 32B travel along the angularly disposed upper surface 74B of the elongated body member 70B of the second inclined ramp 30B, a track 132A is provided along the angularly disposed upper surface 74A of the elongated body member 70A of the first inclined ramp 30A and a track 132B is provided along the angularly disposed upper surface 74B of the elongated body member 70B of the second inclined ramp 30B. The configuration of the tracks 132A and 132B will be dependent, to a large extent, upon the configuration of the wheels 120A, 122A and 124A engaging the track 132A as the first inclined ramp 30A is moved in the to and fro direction; and the configuration of the wheels 120B, 122B and 124B engaging the track 132B as the second inclined ramp 30B is moved in a to and fro direction. For example, desirable results can be obtained wherein the track 132A comprises a plurality of grooves formed in the angularly disposed upper surface 74A of the elongated body member 70A of the first inclined ramp 30A, such as grooves 134A, 136A and 138A; and the track 132B comprises a plurality of grooves formed in the angularly disposed upper surface 74B of the elongated body member 70B of the second inclined ramp 30B, such as grooves 134B, 136B and 138B. Each of the grooves formed in the respective angularly disposed upper surfaces 74A, 74B of the inclined ramps 30A, 30B receives one of the wheels of the first and second ramp engaging assemblies 32A, 32B such that the wheels are disposed in and supported by the grooves for rolling movement therealong. That is, wheel 120A is disposed within the groove 134A for rolling movement therealong, wheel 122A is disposed within the groove 136A for rolling movement therealong, and wheel 124A is disposed within the groove 138A for rolling movement therealong; and wheel 120B is disposed within the groove 134B for rolling movement therealong, wheel 122B is disposed within the groove 136B for rolling movement therealong, and wheel 124B is disposed within the groove 138B for rolling movement therealong. By providing the grooves as described above in the angularly disposed upper surfaces 74A, 74B of the first and second inclined ramps 30A, 30B, undesired lateral movement of the mattress frame 14A is prevented as the angular disposition of the mattress frame 14A is varied by movement of the first and second inclined ramps 30A, 30B along the main frame 12A, and thus the movement of the wheels of the first ramp engaging assembly 32A along the grooves formed in the first inclined ramp 30A, and the movement of the wheels of the second ramp engaging assembly 32B along the grooves formed in the second inclined ramp 30B.

In many instances the overall length of the mattress frame 14A will be greater than the overall length of the main frame 12A to accommodate a conventional or extra length mattress. In such instances, one may still desire to attach the footboard 18A to the tiltable bed frame assembly 10A for aesthetic reasons. In order to permit the user to attach the footboard 18A to the tiltable bed frame assembly 10A of the present invention, the tiltable bed frame assembly 10A further comprises a footboard support assembly 140A connectable to and supported by the main frame 12A. The footboard support assembly 140A is connected to the elongated member 40A and 44A of the main frame 12A such that the footboard support assembly 140A is selectively moveable between a retracted position and an extended position. In the retracted position the footboard support assembly 140A is telescopically received by the elongated members 40A, 44A of the main frame 12A; whereas in the extended position the distal end of the footboard support assembly 140A extends a selected distance outwardly from the end of the main frame 12A to effectively extend the overall length of the main frame 12A. The interconnection of the footboard support assembly 140A to the main frame 12A is substantially identical to that heretofore described with reference to the connection of the footboard support assembly 140 to the main frame assembly 12. Thus, no further comments are deemed necessary for one to fully understand the attachment of the footboard assembly 140A to the main frame 12A, and thus the footboard 18A to the tiltable bed frame assembly 10A.

As previously stated, the to and fro movement of the first and second inclined ramps 30A, 30B along the main frame 12A is simultaneous and in the same direction such that the angular disposition of the mattress frame 14A can be readily altered between a variety of positions. The to an fro movement of the first and second inclined ramps 30A, 30B is accomplished via the ram assembly 150. The ram assembly 150 comprises a ram 34A having a cylinder 147A and a reciprocating member 148A, and ramp connector members 170, 172 extending between and connecting the first inclined ramp 30A to the second inclined ramp 30B in a predetermined spatial relationship. The ram 34A is a linear actuator so that selective activation of the ram 34A results in the desired directional movement of the first and second inclined ramps 30A, 30B. Any suitable ram can be employed to effectuate the selected movement of the first and second inclined ramps 30A, 30B along the main frame 12A for the predetermined distance so that the desired degree of inclination of the mattress frame 14A relative to the main frame 12A can be achieved. Further, the ram 34A will generally be driven by an electric motor connected to a suitable power source for ease in use in a home environment.

As set forth in the discussions relative to the tiltable bed frame assembly 10, the cylinder 147A of the ram 34A is secured to the support member 50A of the main frame 12A; and the distal end of the reciprocating member 148A is connected to the first inclined ramp 30A substantially as shown. The first inclined ramp 30A is thereafter connected to the second inclined ramp 30B by the ramp connector members 170, 172. The length of stroke of the reciprocating member 148A of the ram 34A determines the selected distance that the first and second inclined ramps 30A, 30B travel along the main frame 12A. Further the interconnection of the first and second inclined ramps 30A, 30B (via the ram 34A and the ramp connector members 170, 172) insures that the first and second inclined ramps 30A, 30B move along the main frame 12A simultaneously and in the same direction in response to actuation and movement of the reciprocating member 148A of the ram 34A.

It should be understood that while the ram 34A has been depicted as the means for selectively moving the first and second inclined ramps 30A, 30B along the main frame 12A in a to and fro direction to achieve the changes in the degree of inclination of the mattress frame 14A relative to the main frame 12A, any suitable means well known in the art capable of selectively moving the first and second inclined ramps 30A, 30B in the desired to and fro direction for a predetermined distance can be employed in the practice of the present invention.

From the above description it is clear that the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. An improved tiltable bed frame assembly comprising:

a main frame comprising:

a plurality of elongated members, rigidly interconnected at their adjoining ends to provide a substantially rectangularly shaped main frame having opposed, spatially disposed sides and opposed, spatially disposed ends; and a substantially centrally disposed support member extending between and connected to the elongated members of the main frame ends;

a mattress frame supported by the main frame;

a first inclined ramp supported by the centrally disposed support member of the main frame so as to be disposed below the mattress frame and selectively moveable therealong;

first ramp engaging means connected to the mattress frame and supported on the first inclined ramp for elevationally moving a portion of the mattress frame relative to the main frame as the first inclined ramp is moved along the main frame;

actuation means supported by the main frame and connected to the first inclined ramp for selectively moving the first inclined ramp along the main frame in a to and fro direction so that the angular disposition of the mattress frame relative to the main frame is adjusted in response to travel of the first inclined ramp; and ram means connected to the first inclined ramp for selectively moving the first inclined ramp along the main frame.

2. The improved tiltable bed frame assembly of claim 1 wherein said first inclined ramp comprises:

an elongated body member having a substantially triangularly shaped cross section, the body member further characterized as having a lower substantially planar surface, an angularly disposed upper surface, a first end, a medial portion and an opposed second end, the body member having a recessed portion formed in the lower planar surface on each of the first and second ends and in the medial portion thereof for receiving the elongated members forming the sides of the main frame and the centrally disposed support member of the main frame so that the body member is slideably supported on the main frame, the angularly disposed upper surface of the body member extends in a downward direction.

3. The improved tiltable bed frame assembly of claim 2 wherein the mattress frame comprises:

a pair of substantially parallel spatially disposed elongated side members having a first end and a second end; and a pair of substantially parallel, spatially disposed elongated end members having a first end and a second end, the elongated side members being connected to the elongated end members such that the mattress frame is provided with a substantially rectangularly shaped configuration; and, support means supported by the main frame near one end thereof for pivotally supporting one end of the mattress frame at a predetermined height above the main frame, the other end of the mattress frame attached to the first ramp engaging means so that movement of the first inclined ramp beneath the first ramp engaging means results in elevational movement of the mattress frame end attached to the first ramp engaging means so that the angular disposition of the mattress frame is adjusted relative to the main frame.

4. The improved tiltable bed frame assembly of claim 3 further comprising:

caster means connected to the main frame for supporting the main frame on a supporting surface and for permitting selective movement of the main frame along the supporting surface.

5. The improved tiltable bed frame assembly of claim 3 further comprising:

footboard support means supported by the main frame for supporting a footboard, the footboard support means comprising extension means for selectively extending the length of the main frame, and having a retracted position and an extended position, in the retracted position the extension means being telescopically received by the elongated members of the main frame forming the sides thereof, and in the extended position the extension means extending a selected distance outwardly from the end of the main frame, the extension means having means for securing the extension means to the main frame when said main frame extension means is in a desired position.

6. The improved tiltable bed frame assembly of claim 5 further comprising:

caster means connected to the main frame for supporting the main frame on a supporting surface and for permitting selective movement of the main frame along the supporting surface.

7. An improved tiltable bed frame assembly comprising:

a main frame comprising:

a plurality of elongated members, rigidly interconnected at their adjoining ends to provide the main frame with a substantially rectangularly shaped configuration having opposed, spatially disposed sides and opposed, spatially disposed ends; and a substantially centrally disposed support member exending between and connected to the elongated members of the main frame ends;

a mattress frame supported by the main frame;

a first inclined ramp supported by the centrally disposed support member of the main frame so as to be disposed below the mattress frame and selectively moveable therealong;

a second inclined ramp supported by the centrally disposed support member of the main frame so as to be disposed below the mattress frame and selectively moveable therealong;

first ramp engaging means connected to the mattress frame and supported on the first inclined ramp for elevationally moving a portion of the mattress frame relative to the main frame as the first inclined ramp is moved along the main frame;

second ramp engaging means connected to the mattress frame and supported on the second inclined ramp for elevationally moving another portion of the mattress frame relative to the main frame as the second inclined ramp is moved along the main frame; and actuation means supported by the main frame and connected to the first and second inclined ramps for selectively moving the first and second inclined ramps along the main frame in a to and fro direction so that the angular disposition of the mattress frame relative to the main frame is adjusted in response to travel of the first and second inclined ramps, the actuation means comprising:

ram means connected to the first inclined ramp for selectively moving the first inclined ramp along the main frame; and ramp connector means for connecting the first inclined ramp to the second inclined ramp in a predetermined spatial relationship thereto so that movement of the first inclined ramp along the main frame in response to the ram means simultaneously moves the second inclined ramp in a corresponding direction to movement of the first inclined ramp.

8. The improved tiltable bed frame assembly of claim 7 wherein each of said first and second inclined ramps comprises:

an elongated body member having a substantially triangularly shaped cross section, the body member further characterized as having a substantially planar lower surface, an angularly disposed upper surface, a first end, a medial portion and an opposed second end, the body member having a recessed portion formed in the lower planar surface on each of the first and second ends and in the medial portion thereof for receiving the elongated members forming the sides of the main frame and the centrally disposed support member of the main frame so that the body member is slideably supported on the main frame, the angularly disposed upper surfaces of the body members of the first and second inclined ramps being inclined to extend toward the supporting main frame in opposite directions.

9. The improved tiltable bed frame assembly of claim 8 wherein the main frame further comprises:

support means supported by the main frame for pivotally supporting a midportion of the mattress frame at a predetermined height above the main frame so that the support means serves as a fulcrum for the mattress frame as the angular disposition of the mattress frame is adjusted relative to the main frame in response to elevational movement of the first and second ramp engaging means effected by the angularly disposed upper surfaces of the first and second inclined ramps as the first and second inclined ramps are selectively moved along the main frame.

10. The improved tiltable bed frame assembly of claim 9 further comprising:

footboard support means supported by the main frame for supporting a footboard, the footboard support means comprising extension means for selectively extending the length of the main frame, and having a retracted position and an extended postiion, in the retracted position the extension means being telescopically received by the elongated members of the main frame forming the sides thereof, and in the extended position the extension means extending a selected distance outwardly from the end of the main frame, the extension means having means for securing the extension means to the main frame when said main frame extension means is in a desired position.

11. The improved tiltable bed frame assembly of claim 9 wherein the elongated body member of each of said first and second inclined ramps further comprises:

track means disposed along the angularly disposed upper surface for engaging and guiding its respective ramp engaging means as the body member is moved along the main frame relative to the ramp engaging means in response to the actuation means.

12. The improved tiltable bed frame assembly of claim 11 wherein the first ramp engaging means comprises:

a plurality of wheel members connected to the mattress frame so as to extend downwardly therefrom, each of said wheel members adapted to engage the track means along the angularly disposed upper surface of the body member of the first inclined ramp; and, wherein the second ramp engaging means comprises:

a plurality of wheel members connected to the mattress frame so as to extend downwardly therefrom, each of said wheel members aapted to engage the track means along the angularly disposed upper surface of the body member of the second inclined ramp.

13. The improved tiltable bed frame assembly of claim 12 wherein the track means comprises a plurality of grooves formed in the body member of the first and second inclined ramps along the angularly disposed upper surfaces thereof, and wherein one of each of the wheel members of the first ramp engaging means is disposed for support in one of the grooves of the first inclined ramp for rolling movement therealong, and wherein one of each of the wheel members of the second ramp engaging means is disposed for support in one of the grooves of the second inclined ramp for rolling movement therealong.

14. The improved tiltable bed frame assembly of claim 13 wherein the mattress frame comprises:

a pair of substantially parallel spatially disposed elongated side members having a first end and a second end; and, a pair of substantially parallel, spatially disposed elongated end members having a first end and a second end, the elongated side members being connected to the elongated end members such that the mattress frame is provided with a substantially rectangularly shaped configuration, one end of the mattress frame attached to the first ramp engaging means and the opposed end of the mattress frame attached to the second ramp engaging means such that movement of the first and second inclined ramps results in elevational movement of the first and second ramp engaging means by the angularly disposed upper surfaces thereof so that the angular disposition of the mattress frame is adjusted relative to the main frame.

15. The improved tiltable bed frame assembly of claim 14 further comprising:

footboard support means supported by the main frame for supporting a footboard, the footboard support means comprising extension means for selectively extending the length of the main frame, and having a retracted position and an extended position, in the retracted position the extension means being telescopically received by the elongated members of the main frame forming the sides thereof, and in the extended position the extension means extending a selected distance outwardly from the end of the main frame, the extension means having means for securing the extension means to the main frame when said main frame extension means is in a desired position.

16. The improved tiltable bed frame assembly of claim 15 further comprising:

caster means connected to the main frame for supporting the main frame on a supporting surface and for permitting selective movement of the main frame along the supporting surface.

* * * * *